US006374920B1

(12) United States Patent
Phillips et al.

(10) Patent No.: US 6,374,920 B1
(45) Date of Patent: Apr. 23, 2002

(54) VERTICAL SIDEWALL SPRINKLER ARRANGEMENT

(75) Inventors: Hudson Phillips, South Ozone Park; Harmohindra Bhandal, New City, both of NY (US)

(73) Assignee: The Reliable Automatic Sprinkler Co., Inc., Mount Vernon, NY (US)

( * ) Notice: Subject to any disclaimer, the term of this patent is extended or adjusted under 35 U.S.C. 154(b) by 43 days.

(21) Appl. No.: 09/594,904

(22) Filed: Jun. 15, 2000

(51) Int. Cl.[7] ..... A62C 37/08

(52) U.S. Cl. ..... 169/37; 169/42; 239/518; 239/521; 239/524

(58) Field of Search ..... 169/37, 42; 239/498, 239/504, 518, 521, 524

(56) References Cited

U.S. PATENT DOCUMENTS

| | | | | | |
|---|---|---|---|---|---|
| 2,046,169 | A | | 6/1936 | Knight | 169/37 |
| 2,101,694 | A | * | 12/1937 | Tyden | 169/37 |
| 2,199,142 | A | * | 4/1940 | Russell | 169/37 |
| 3,880,239 | A | | 4/1975 | Vorkapich | 169/37 |
| 4,296,815 | A | | 10/1981 | Mears | 169/37 |
| 4,585,069 | A | * | 4/1986 | Whitaker | 169/37 |
| 4,987,957 | A | | 1/1991 | Galaszewski | 169/37 |
| 5,669,449 | A | | 9/1997 | Polan et al. | 169/16 |
| 5,727,737 | A | | 3/1998 | Bosio et al. | 239/504 |
| 5,810,263 | A | * | 9/1998 | Tramm | 239/518 |

* cited by examiner

*Primary Examiner*—Steven J. Ganey
(74) *Attorney, Agent, or Firm*—Baker Botts L.L.P.

(57) ABSTRACT

In the representative embodiments described in the specification, a vertical sidewall sprinkler arrangement has a deflector supported from the junction of a pair of frame arms of the sprinkler and arranged to direct water in a generally horizontal direction. The deflector has a planar central portion substantially perpendicular to the sprinkler axis and extending in a direction parallel to the plane of the frame arms of the sprinkler on one side of the sprinkler axis; a first angled portion on the opposite side of the sprinkler axis, bent at an angle of about 50° from the planar central portion toward the sprinkler; and second and third angled portions extending outwardly from the planar central portion of the deflector and from the plane of the frame arms and bent toward the frame arms at an angle of at least 30° from the planar central portion.

20 Claims, 5 Drawing Sheets

VERTICAL SIDEWALL SPRINKLER ARRANGEMENT

BACKGROUND OF THE INVENTION

This invention relates to vertical sidewall sprinklers and more specifically to deflectors included in vertical sidewall sprinklers.

A vertical sidewall sprinkler is designed to provide a specified amount of water to a specified area as a function of time. The amount of water provided to an area can be increased by reducing the distance between sprinklers. However, when sprinklers are placed too close together, cold soldering occurs. In cold soldering, the water released from an actuated sprinkler cools the thermally responsive element of one or more adjacent sprinklers preventing the adjacent sprinklers from actuating.

The Vorkapich U.S. Pat. No. 3,880,239 shows a vertical sidewall sprinkler having a deflector with a central horizontal planar section extending outwardly in a direction perpendicular to the plane of the frame arms on one side and having a portion on the opposite side of the frame arms which is bent downwardly and then inwardly, along with downwardly inclined side surface portions on opposite sides of the central portion of the deflector. The Knight U.S. Pat. No. 2,046,169 discloses a vertical sidewall sprinkler having a deflector which is substantially continuously curved downwardly from a horizontal disposition on one side of the plane of the sprinkler frame arms to an inclined disposition extending through the plane of the frame arms to a nearly vertical disposition on the opposite side of the plane of the frame arms. That deflector has no inclined portions on opposite sides of the portion which is perpendicular to the plane of the frame arms. The Polan et al. U.S. Pat. No. 5,669,449 shows vertical sprinklers with deflectors arranged to deflect discharged water via opposing downwardly facing, open channels and outwardly flared sidewalls.

SUMMARY OF THE INVENTION

Accordingly, it is an object of the present invention to provide a vertical sidewall sprinkler arrangement which overcomes disadvantages of the prior art.

Another object of the present invention is to provide a vertical sidewall sprinkler arrangement that allows for sprinklers to be placed closer to each other without cold soldering.

These and other objects of the invention are attained by providing a vertical sidewall sprinkler including a sprinkler body having a passage for water and a pair of frame arms projecting forwardly and supporting a thermally responsive element which retains a plug sealing the passage in the sprinkler body. A deflector member is supported from the junction of the frame arms and arranged to direct water in a generally horizontal direction when the sprinkler is mounted vertically. For this purpose, the deflector has a planar central portion substantially perpendicular to the sprinkler axis and extending in a direction parallel to the plane of the frame arms of the sprinkler on one side of the sprinkler axis. On the opposite side of the sprinkler axis the deflector is bent at an angle of about 50° toward the sprinkler passage. The planar central portion of the deflector has a curved end edge and straight edge portions extending away from that end in the regions spaced outwardly from the plane of the frame arms and those regions are bent toward the sprinkler passage outlet at an angle of at least 30° from the planar central portion. Using two sprinklers having this arrangement which are spaced between six and ten feet apart and located six inches in front of a wall section, good water distribution can be obtained over a 100 square foot area centered between the sprinklers while providing good backwall wetting but avoiding cold soldering.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
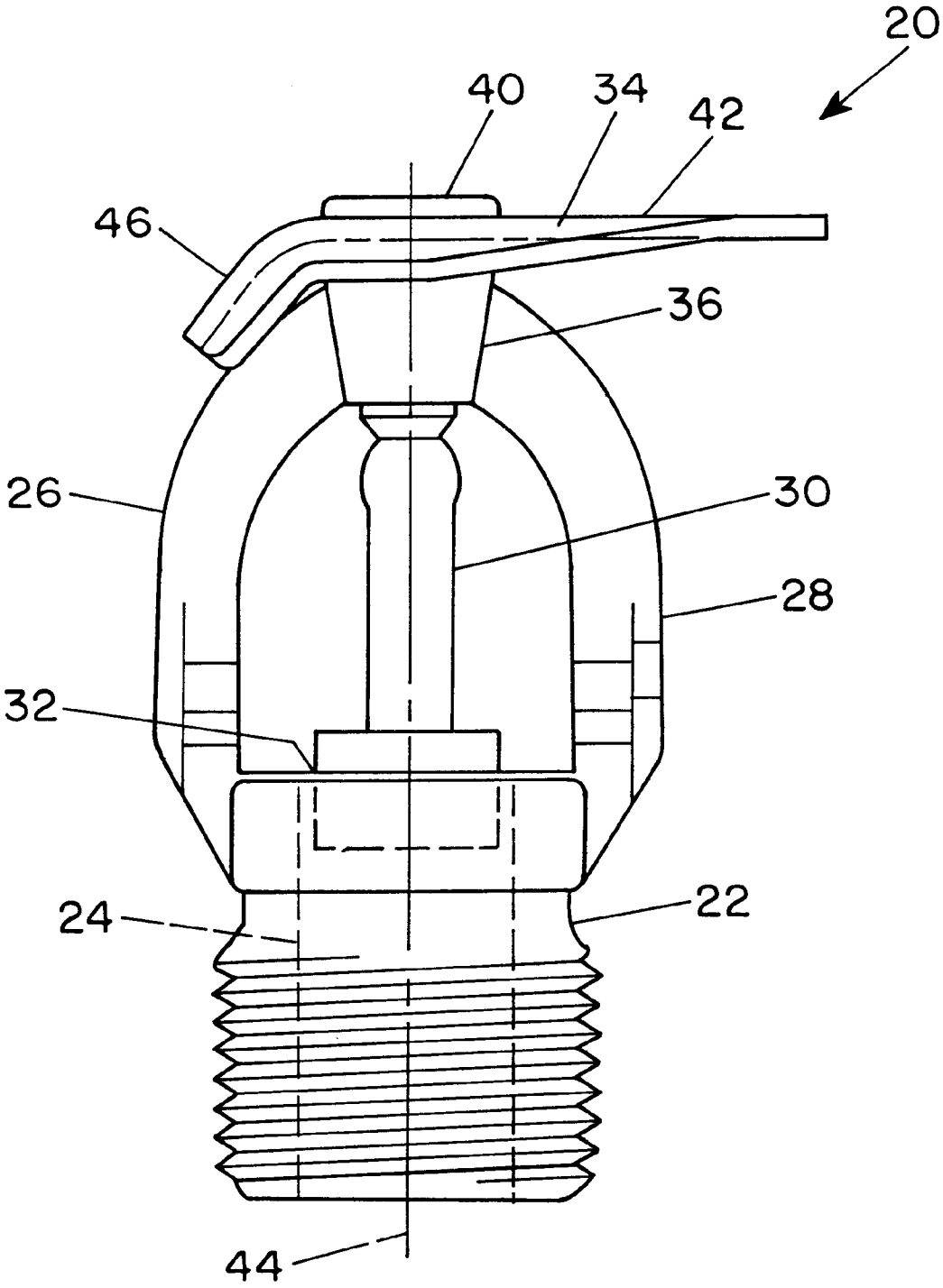
FIG. 1 is a side view illustrating a representative embodiment of a vertical sidewall sprinkler arrangement in accordance with the invention.
Figure 2:
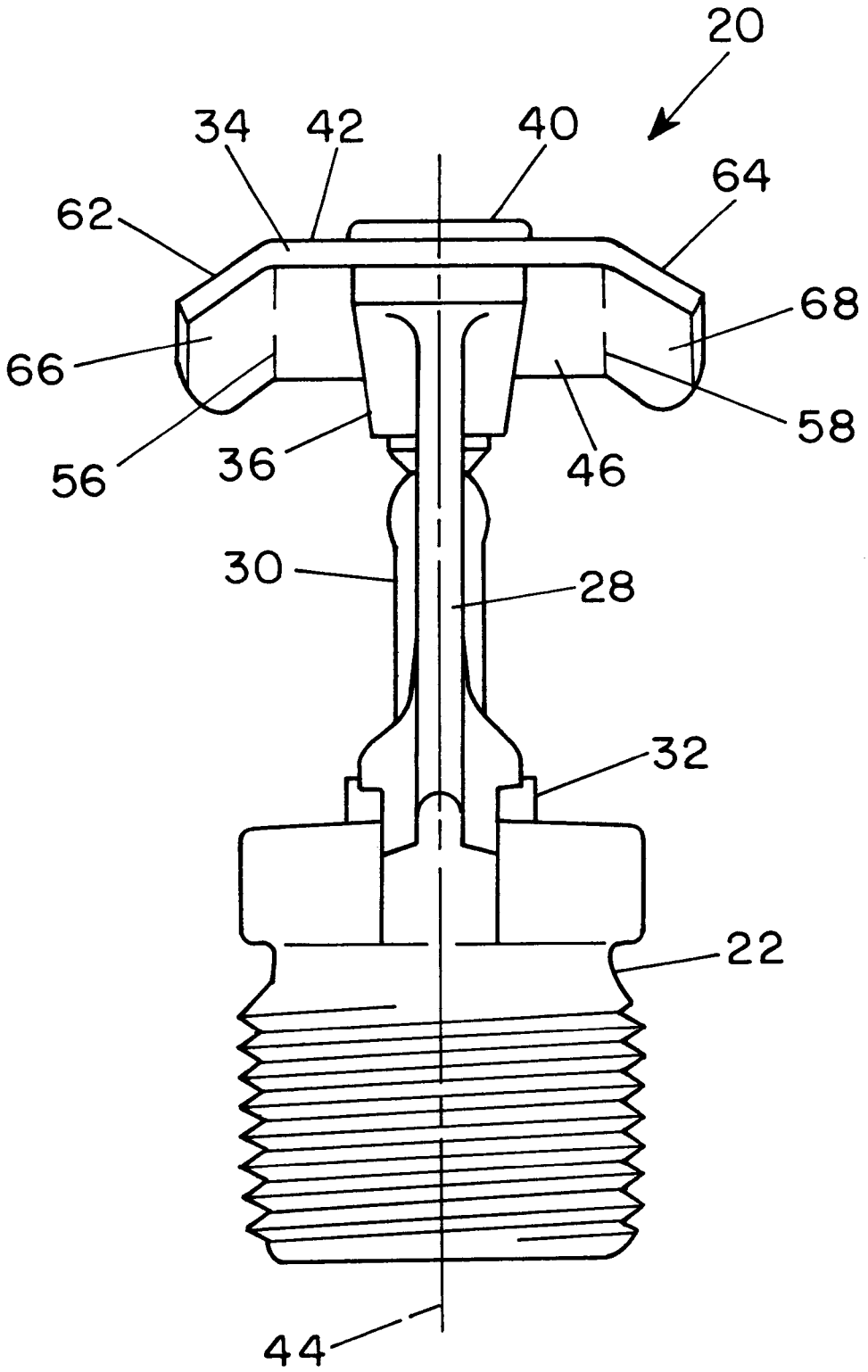
FIG. 2 is a front view illustrating the arrangement shown in FIG. 1.

In the typical embodiment of the invention illustrated in the drawings, a vertical sidewall sprinkler arrangement 20 includes a sprinkler body 22 having a passage 24 for water and a pair of frame arms 26 and 28 projecting forwardly and supporting a thermally responsive element 30 which retains a plug 32 sealing the passage 24 in the sprinkler body 22. A deflector member 34 is supported from the junction 36 of the frame arms 26, 28 at an opening 38 through which the top 40 of the junction protrudes. The deflector member 34 is arranged to direct water in a generally horizontal direction when the sprinkler arrangement 20 is mounted vertically, either pendently or upright. For this purpose, the deflector member 34 has a planar central portion 42 substantially perpendicular to the sprinkler axis 44 and extending in a direction parallel to the plane of the frame arms 26, 28 of the sprinkler body 22 on one side of the sprinkler axis 44.

Figure 3:
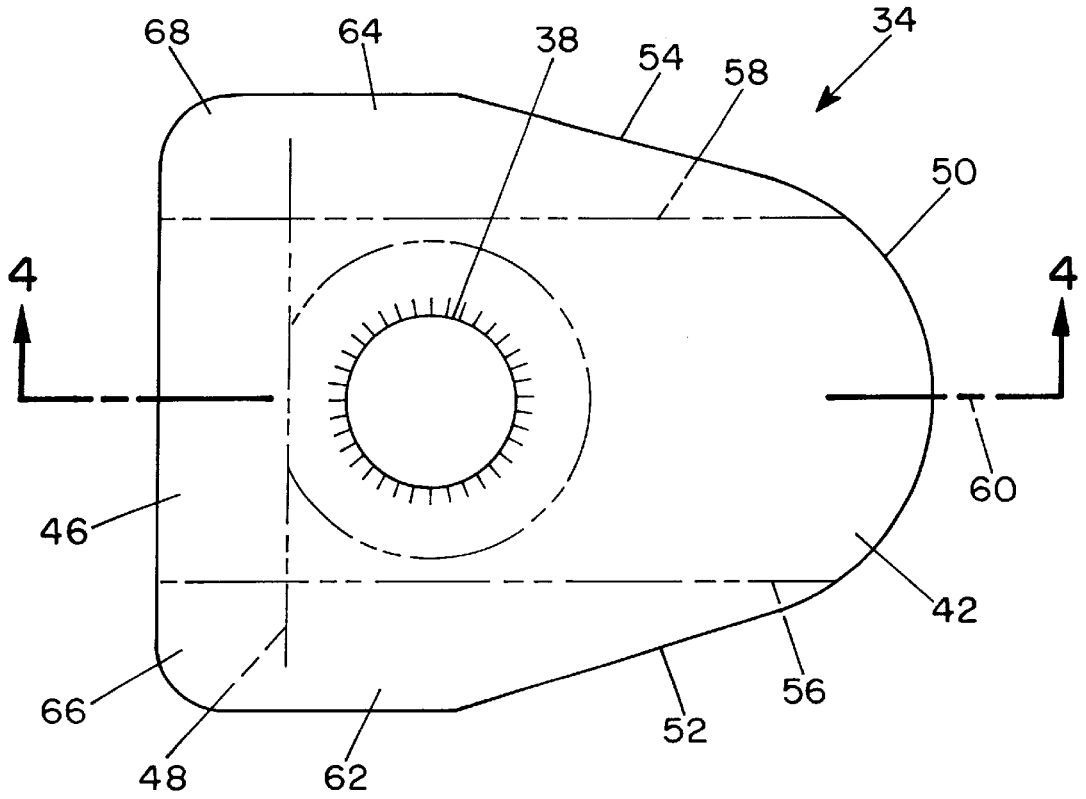
FIG. 3 is a top view illustrating the deflector of the arrangement shown in FIGS. 1 and 2.
Figure 4:
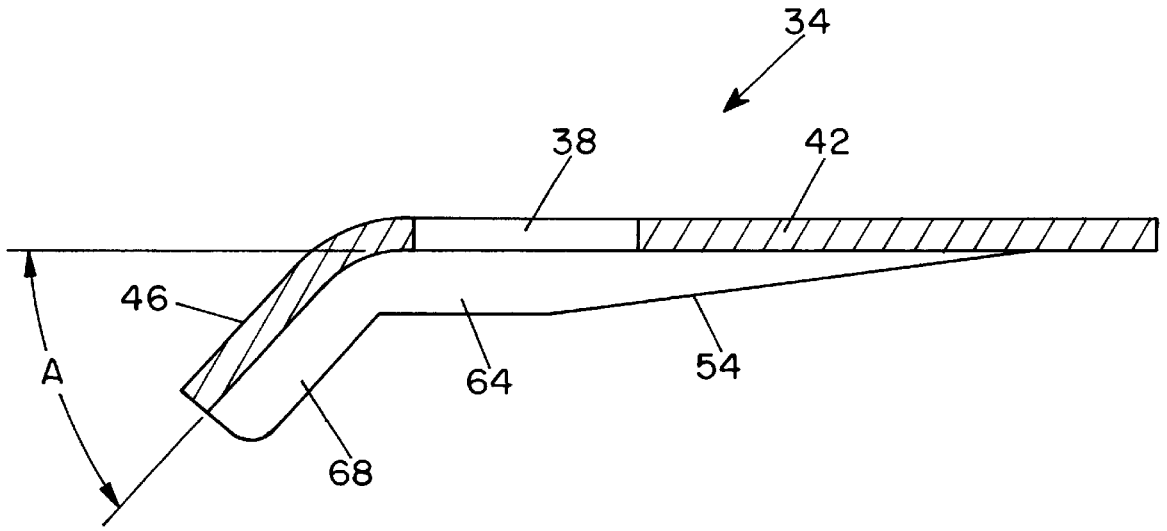
FIG. 4 is a cross-sectional side view taken on the line 4—4 of FIG. 3 and looking in the direction of the arrows.
Figure 5:
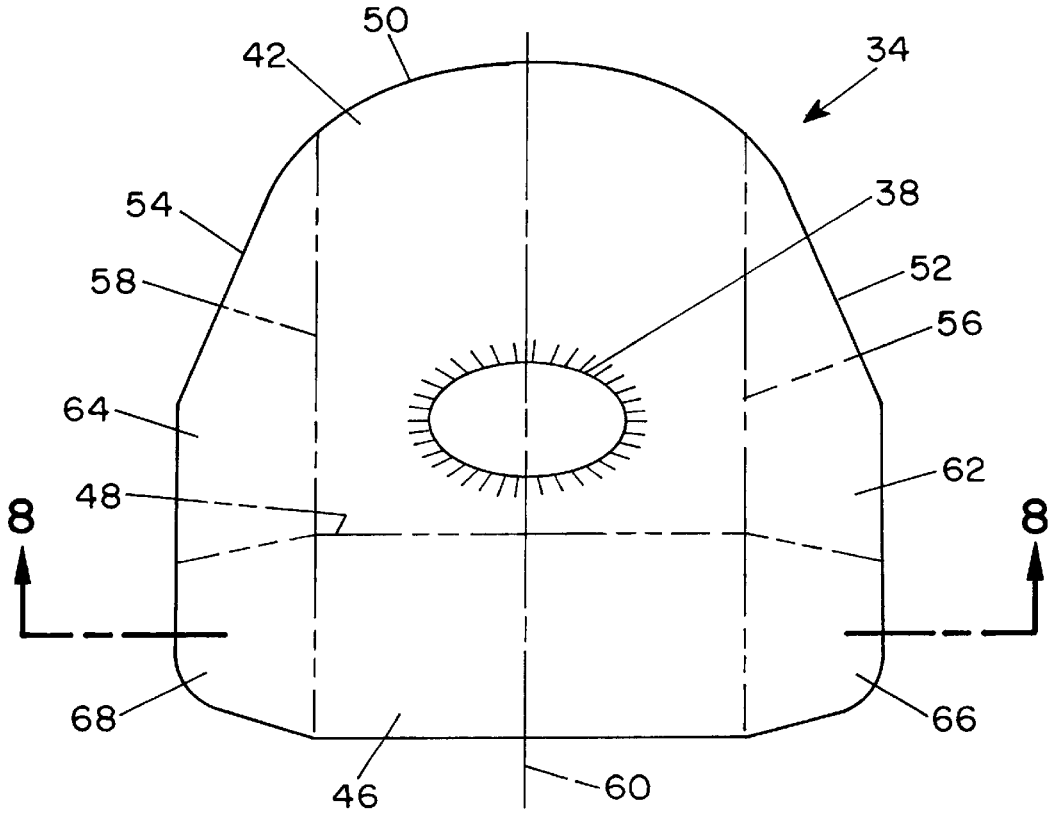
FIG. 5 is a plan view normal to the first angled portion of the deflector shown in FIGS. 1 and 2.
Figure 6:
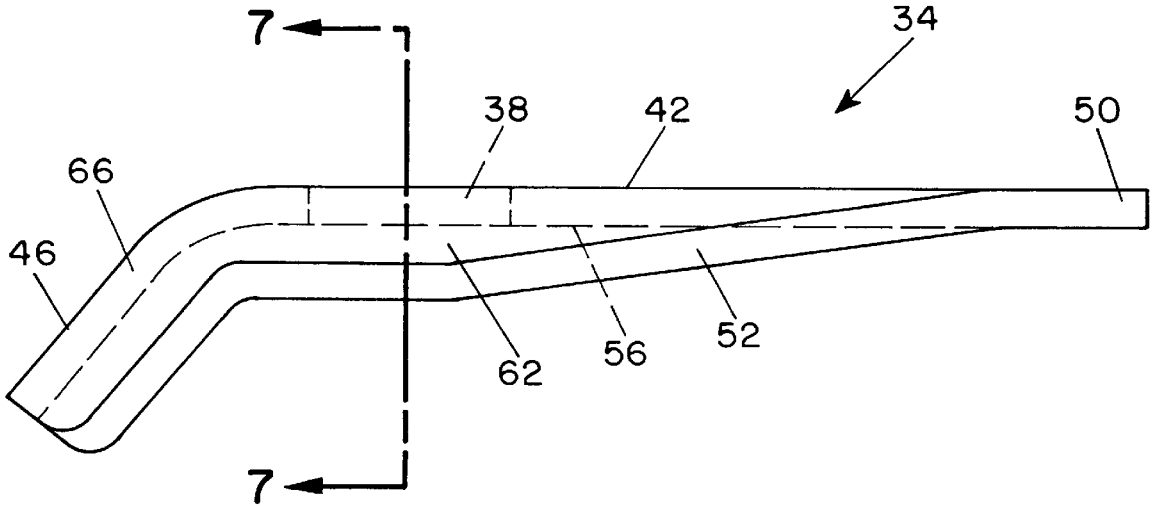
FIG. 6 is a side view of the deflector shown in FIG. 5.
Figure 7:
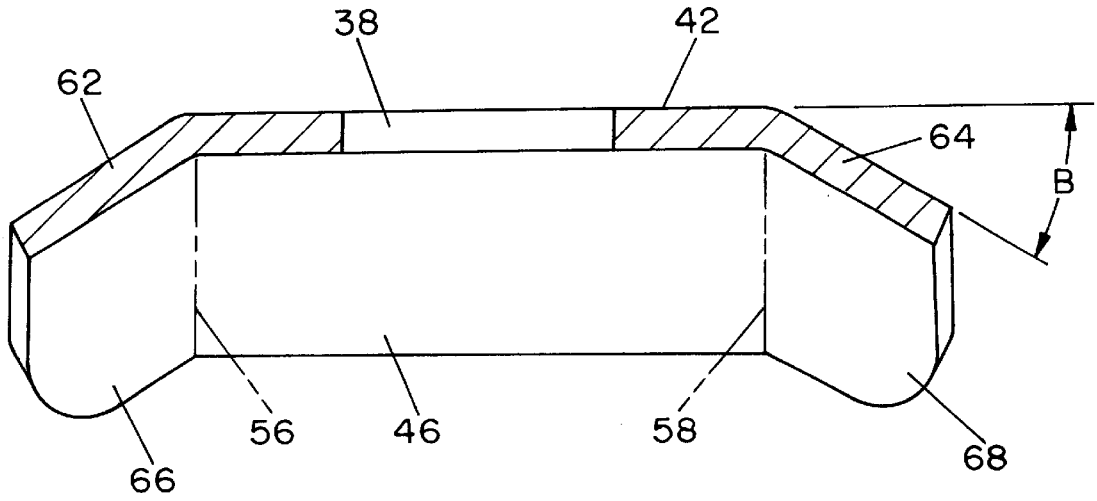
FIG. 7 is a cross-sectional front view taken on the line 7—7 of FIG. 6 and looking in the direction of the arrows.
Figure 8:
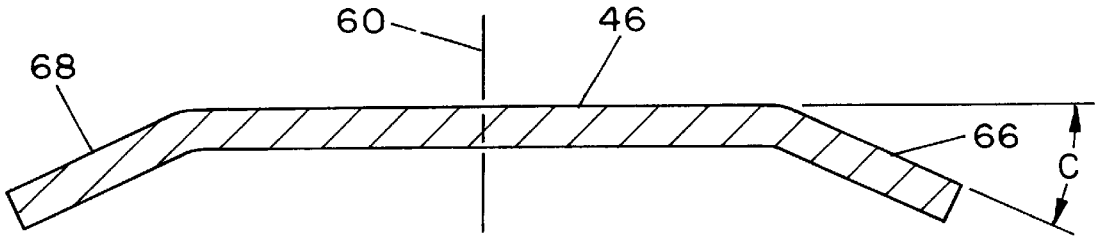
FIG. 8 is a cross-sectional back view taken on the line 8—8 of FIG. 5 and looking in the direction of the arrows.

On the opposite side of the sprinkler axis 44, the deflector member 34 is bent at an angle A from the planar central portion 42, preferably about 50°, toward the sprinkler passage 24 forming a first angled portion 46 as shown in FIGS. 3 and 4. The first angled portion is further defined by a first bend line 48. The planar central portion 42 of the deflector has a curved end edge 50 and straight edge portions 52 and 54 extending away from the curved end edge 50 in the regions spaced outwardly from the plane of the frame arms 26, 28. Those regions are further defined by second and third bend lines 56 and 58 which extend parallel to the center line 60 of the deflector member 34 and extend to the end of the first angled portion 46. Those regions are bent toward the sprinkler passage 24 and the frame arms 26, 28 at an angle B as shown in FIG. 7, which is about 30° or greater from the plane of the central portion 42, forming second and third angled portions 62 and 64. The preferred angle from the horizontal forming the second and third angled portions 62, 64 is about 32°; however, the angle can also be 35° or greater. As shown in FIG. 8, sections 66 and 68 of the second and third angled portions 62, 64 that are also part of the first angled portion 46 are bent at an angle C, which is approximately 25°, relative to the first angled portion 46 toward the sprinkler passage 24 and the frame arms 26, 28.

In a typical embodiment, the nominal orifice size of the passage 24 is 0.5 inches with the deflector 34 between 4 and 12 inches from the ceiling, the sprinklers between 6 and 10 feet apart, the service pressure at 100 psig and the total water flow at 30 gallons per minute. The deflector member 34 is approximately 1.39 inches long, from the tip of the curved end edge 50 to the distal end of the first angled portion 46 along the center line 60, 1.5 inches long prior to bending. The deflector member is approximately 1.165 inches wide, prior to bending, across the first angled portion 46 and approximately 0.0625 inches thick. The second and third bend lines, 56 and 58 are approximately 0.34375 inches from the center line 60. The first bend line 48 is slightly greater than approximately 1.090 inches from the tip of the curved end edge 50. The opening 38 is centered approximately 0.920 inches from the tip of the curved end edge 50 and has a radius of approximately 0.17 inches with deep radial serrations at about every 10°. The straight edge portions 52 and 54 form an included angle of approximately 32°. The curved end edge 50 has a radius of approximately 0.440 inches.

Using two sprinklers having this arrangement which are spaced between 6 and 10 feet apart and located 6 inches in front of a wall section, good water distribution can be obtained over a 100 square foot area centered between the sprinklers while providing good backwall wetting but avoiding cold soldering. The sprinklers can be oriented either as pendent sprinklers or as upright sprinklers.

Although the invention has been described herein with reference to specific embodiments, many modifications and variations therein will readily occur to those skilled in the art. Accordingly, all such variations and modifications are included within the intended scope of the invention.

We claim:

1. A deflector for a vertically mounted sidewall sprinkler having a sprinkler axis, the deflector supported from the junction of a pair of frame arms of the sprinkler and arranged to direct water in a generally horizontal direction, comprising:

a planar central portion substantially perpendicular to the sprinkler axis and extending in a direction parallel to the plane of the frame arms of the sprinkler on one side of the sprinkler axis;

a first angled portion on the opposite side of the sprinkler axis, bent at an angle from the planar central portion toward the sprinkler; and second and third angled portions extending outwardly from the planar central portion of the deflector and from the plane of the frame arms and bent toward the frame arms at an angle of at least 30° from the planar central portion;

wherein the first angled portion is bent at an angle of between about 45° and about 55° from the plane of the central portion toward the sprinkler.

2. A deflector according to claim 1 wherein the second and third angled portions are bent toward the frame arms at an angle of between about 30° and about 35° from the plane of the central portion.

3. A deflector according to claim 1 wherein the second and third angled portions are bent toward the frame arms at an angle of about 32° from the plane of the central portion.

4. A deflector according to claim 1 wherein the first angled portion is bent at an angle of between about 49° and about 51° from the plane of the central portion toward the sprinkler.

5. A deflector according to claim 4 wherein the second and third angled portions are bent toward the frame arms at an angle of between about 30° and about 35° from the plane of the central portion.

6. A deflector according to claim 4 wherein the second and third angled portions are bent toward the frame arms at an angle of about 32° from the plane of the central portion.

7. A deflector for a vertically mounted sidewall sprinkler having a sprinkler axis, the deflector supported from the junction of a pair of frame arms of the sprinkler and arranged to direct water in a generally horizontal direction, comprising:

a planar central portion substantially perpendicular to the sprinkler axis and extending in a direction parallel to the plane of the frame arms of the sprinkler on one side of the sprinkler axis;

a first angled portion on the opposite side of the sprinkler axis, bent at an angle from the planar central portion toward the sprinkler; and second and third angled portions extending outwardly from the planar central portion of the deflector and from the plane of the frame arms and bent toward the frame arms at an angle of at least 30° from the planar central portion;

wherein the second and third angled portions are bent toward the frame arms at an angle of between about 30° and about 35° from the plane of the central portion.

8. A deflector according to claim 7 wherein the second and third angled portions are bent toward the frame arms at an angle of about 32° from the plane of the central portion.

9. A deflector according to claim 7 wherein sections of the second and third angled portions are part of the first angled portion and are bent at an angle of about 25° from the first angled portion toward the frame arms.

10. A deflector according to claim 9 wherein the planar central portion includes a curved end edge and straight edge portions extending away from the curved end edge and spaced outwardly from the plane of the frame arms.

11. A deflector for a vertically mounted sidewall sprinkler having a sprinkler axis, the deflector supported from the junction of a pair of frame arms of the sprinkler and arranged to direct water in a generally horizontal direction, comprising:

a planar central portion substantially perpendicular to the sprinkler axis and extending in a direction parallel to the plane of the frame arms of the sprinkler on one side of the sprinkler axis;

a first angled portion on the opposite side of the sprinkler axis, bent at an angle from the planar central portion toward the sprinkler; and second and third angled portions extending outwardly from the planar central portion of the deflector and from the plane of the frame arms and bent along a line substantially parallel to the plane of the frame arms and toward the frame arms at an angle of about 30° from the plane of the central portion.

12. A deflector according to claim 11 wherein the first angled portion is bent at an angle of between about 45° and about 55° from the plane of the central portion toward the sprinkler.

13. A deflector according to claim 12 wherein the second and third angled portions are bent toward the frame arms at an angle of between about 30° and about 35° from the plane of the central portion.

14. A deflector according to claim 12 wherein the second and third angled portions are bent toward the frame arms at an angle of about 32° from the plane of the central portion.

15. A deflector according to claim 11 wherein the first angled portion is bent at an angle of between about 49° and about 51° from the plane of the central portion toward the sprinkler.

16. A deflector according to claim 11 wherein the second and third angled portions are bent toward the frame arms at an angle of between about 30° and about 35° from the plane of the central portion.

17. A deflector according to claim 11 wherein sections of the second and third angled portions are part of the first angled portion and are bent at an angle of about 25° from the first angled portion toward the frame arms.

18. A deflector according to claim 17 wherein the planar central portion includes a curved end edge and straight edge portions extending away from the curved end edge and spaced outwardly from the plane of the frame arms.

19. A vertical sidewall sprinkler arrangement comprising:

a sprinkler body having a passage for water and a sprinkler axis;

a pair of frame arms projecting forwardly from the sprinkler body at one end and forming a junction at the other end;

a plug sealing the passage;

a thermally responsive element between the plug and the proximal end of the junction for retaining the plug in the passage; and a deflector coupled to the distal end of the junction, wherein the deflector comprises:

a planar central portion extending substantially perpendicular to the sprinkler axis and projecting in a direction parallel to the plane of the frame arms of the sprinkler on one side of the sprinkler axis;

a first angled portion on the opposite side of the sprinkler axis, bent at an angle from the plane of the central portion toward the sprinkler; and second and third angled portions extending outwardly from the planar central portion of the deflector and from the plane of the frame arms and bent toward the frame arms at an angle of at least 30° from the plane of the central portion;

wherein the first angled portion is bent at an angle of between about 45° and about 55° from the plane of the central portion toward the sprinkler.

20. A vertical sidewall sprinkler arrangement according to claim 19 wherein the second and third angled portions are bent toward the frame arms at an angle of about 32° from the plane of the central portion.

* * * * *

UNITED STATES PATENT AND TRADEMARK OFFICE

CERTIFICATE OF CORRECTION

PATENT NO. : 6,374,920 B1
DATED : April 23, 2002
INVENTOR(S) : Phillips et al.

It is certified that error appears in the above-identified patent and that said Letters Patent is hereby corrected as shown below:

Column 3,
Line 30, “pendent” should read -- pendant --
Line 53, “portion;” should read -- portion, --

Column 4,
Line 23, “portion;” should read -- portion, --

Column 6,
Line 16, “portion;” should read -- portion, --

Signed and Sealed this

Nineteenth Day of November, 2002

*Attest:*

*Attesting Officer*

JAMES E. ROGAN
*Director of the United States Patent and Trademark Office*